United States Patent [19]

Ball

[11] Patent Number: 4,581,976

[45] Date of Patent: Apr. 15, 1986

[54] REINFORCED MUSICAL INSTRUMENT STRING

[75] Inventor: Sterling C. Ball, Newport Beach, Calif.

[73] Assignee: Ernie Ball, Inc., San Luis Obispo, Calif.

[21] Appl. No.: 645,088

[22] Filed: Aug. 28, 1984

[51] Int. Cl.[4] ..... G10D 3/10

[52] U.S. Cl. ..... 84/297 S

[58] Field of Search ..... 84/199, 297 S, 297 R, 84/298–302, 304–306

[56] References Cited

U.S. PATENT DOCUMENTS

| | | | |
|---|---|---|---|
| 443,809 | 12/1890 | Albert | 84/199 |
| 687,984 | 12/1901 | Heydenreich | 84/297 |
| 1,244,549 | 10/1917 | Schermerhorn | 84/297 |
| 1,339,953 | 5/1920 | Graiver | 84/297 S |
| 1,363,902 | 12/1920 | Muller | 89/297 |
| 1,468,323 | 9/1923 | Olson | 84/297 |
| 1,617,102 | 2/1927 | Cohn | 84/297 |
| 1,849,463 | 3/1932 | Lindstedt | 84/199 |
| 2,112,088 | 3/1938 | Gould, Jr. | 84/199 |
| 2,205,144 | 6/1940 | Kaplan | 84/297 |
| 2,535,143 | 12/1950 | Kosmis, Jr. | 84/297 |
| 3,313,196 | 4/1967 | Mari | 84/297 |
| 3,777,613 | 12/1973 | Chaffee et al. | 84/297 |
| 4,037,506 | 7/1977 | How | 84/297 |
| 4,164,806 | 8/1979 | Stone et al. | 29/517 |
| 4,184,405 | 1/1980 | How | 84/297 |

FOREIGN PATENT DOCUMENTS

| | | | |
|---|---|---|---|
| 455176 | 1/1928 | Fed. Rep. of Germany | 84/297 |
| 512676 | 11/1930 | Fed. Rep. of Germany | 84/297 |
| 2365850 | 5/1978 | France | 84/297 |
| 237342 | 7/1925 | United Kingdom | 84/297 |

*Primary Examiner*—Lawrence R. Franklin

*Attorney, Agent, or Firm*—Knobbe, Martens, Olson & Bear

[57] ABSTRACT

A musical instrument string includes a core wire, preferably round in cross section, and is bent a short distance from one end thereof to form a loop. The end segment of the core wire is twisted together with a second segment of the core wire that is adjacent the loop to form a looped end on the musical instrument string and a twisted segment adjacent the looped end. A wrap wire wound tightly around the twisted segment of the core wire reinforce the string against breakage at the twisted segment. The length of the wrapped section of the core wire is small fraction of the overall length of the core wire and musical instrument string so that when the string is installed on the instrument the wrapped portion does not extend beyond the bridge.

10 Claims, 5 Drawing Figures

REINFORCED MUSICAL INSTRUMENT STRING

BACKGROUND OF THE INVENTION

The present invention relates to the field of strings for musical instruments such as guitars, banjos, and mandolins. Stringed musical instruments typically have a body, which contains an anchor to which the strings are attached, and a bridge, over which the strings are pulled taut. A neck having a fingerboard is attached to one end of the body, and at the end of the neck is the head with the tuning keys. One end of each string is attached to the anchor on the instrument body and the other end is attached to one of the tuning keys. The string is pulled taut across the bridge and along the fingerboard by turning the tuning key. Each string is tuned to produce a different pitch, which is determined by the length of string allowed to vibrate, the mass per unit length of the string, and the tension applied to the string.

One of the most common stringed musical instruments is the guitar. The acoustic guitar has been long manufactured and used and the electric guitar is a popular instrument of the 20th century. The string of the invention is particularly advantageous for use with electric guitars, although the string can be used on any of a number of musical instruments.

An electric guitar typically has six strings, three of which are generally "plain" strings, consisting of a single strand of wire, and three of which are "wrapped" strings, consisting of a core wire, which is generally hexagonal in shape, and around which is tightly wound along its entire length a thin wrap wire. The wrapped wires are thicker and have a greater mass per unit length than the plain wires. Thus, the wrapped wires have a lower resonance frequency and a lower pitch sound when plucked. Strings for electric guitars are generally approximately 41 inches in length.

SUMMARY OF THE INVENTION

The invention is a single strand or plain musical instrument string that is less prone to breakage than strings used in the past. The musical instrument string of the invention includes a core wire, having a looped end, and a twisted segment adjacent the looped end, with wrap wire wound tightly around the twisted segment of the core wire. The length of core wire wrapped with the wrap wire is a small fraction of the overall length of the core wire. In its preferred embodiment, the musical instrument string additionally includes a substantially spool shaped cylinder held within the loop at the looped end of the musical instrument string for attachment to the string mount on the instrument body.

DETAILED DESCRIPTION OF THE PREFERRED EMBODIMENT

Figure 1:
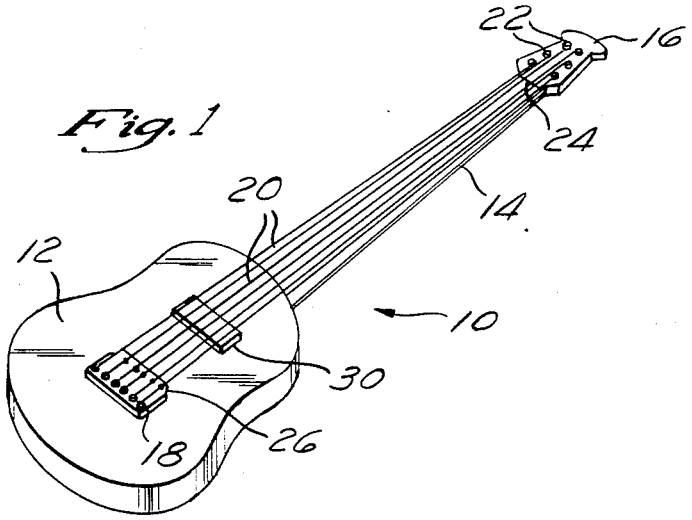
FIG. 1 is a perspective view of an electric guitar on which the string of the invention can be mounted.

A stringed musical instrument 10 such as an electric guitar includes a body 12, a neck 14, and a head 16. On the body 12 of the guitar is an anchor or mounting 18 for holding the ends of the instrument strings 20. One end of each string 20 is attached to the anchor 18.

At the free end of the neck 14 is the head 16, which holds the tuning keys 22. Each tuning key 22 corresponds to one of the strings 20, and holds the second end of the instrument string 20. As is known in the art, turning the tuning key 22 adjusts the tension of the string 20 attached to the tuning key.

Where the neck 14 joins the head 16 is the nut 24, which extends across the end of the neck. When the instrument strings are installed and tightened, they press against this nut 24, to fix the string and provide an end to the vibration length of the string.

Figure 2:
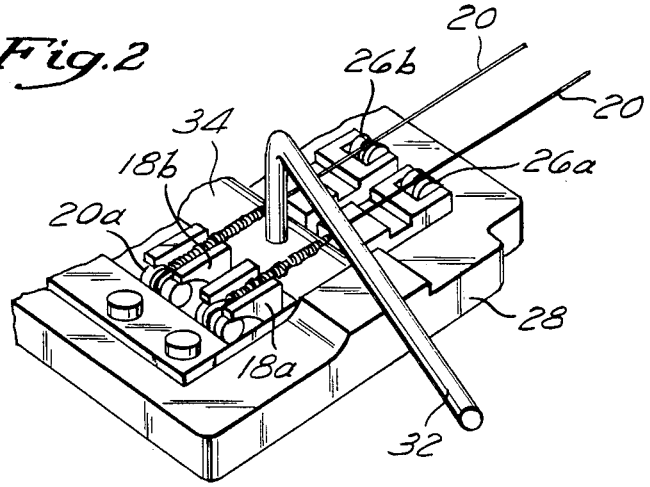
FIG. 2 is a close-up perspective view of one string anchor and bridge mechanism for mounting the guitar strings on the body of the electric guitar, with strings of the invention mounted thereon.
Figure 3:
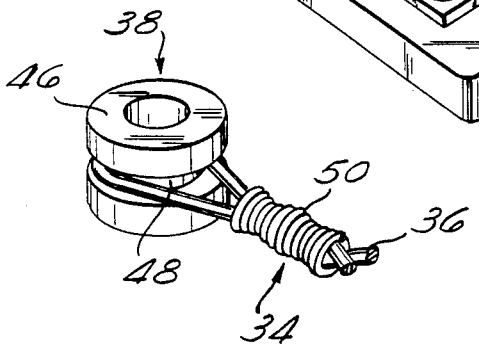
FIG. 3 a perspective partially cut-away close-up view of the ball end of one embodiment of the reinforced string of the invention.
Figure 4:
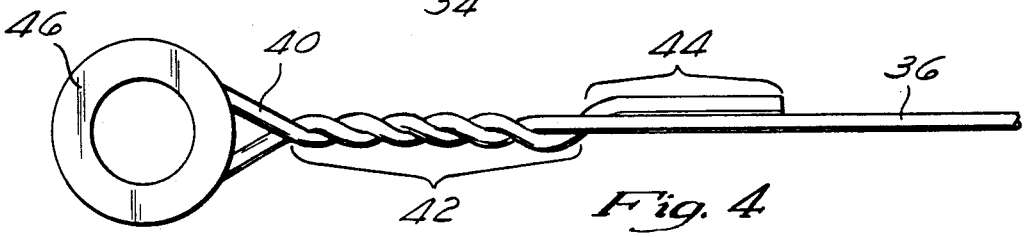
FIG. 4 is a side elevational view of a single strand musical instrument string prior to installation of the wrap wire.
Figure 5:
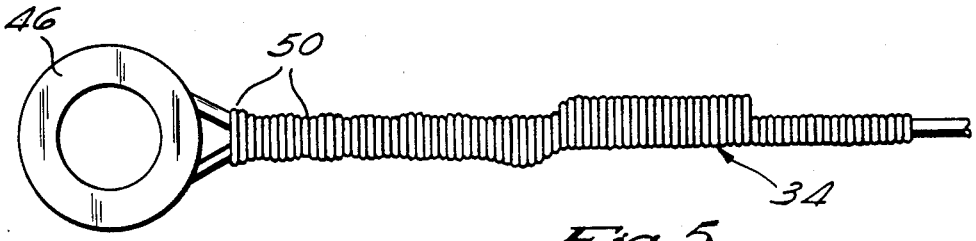
FIG. 5 is a side elevational view of the reinforced string of the invention.

Mounted on the body 12 is a bridge 26 over which each string 20 passes when installed and tightened. The bridge 26 of the guitar shown in FIGS. 1 and 2 is a bridge in having individual bridge mountings **26*a*, 26*b* connected together below the bridge and mounting structure 28 surface, but the person skilled in the art will recognize that a simple one piece bridge structure separate from the string anchors may hold all the strings. The bridge 26 holds the string 20 to provide the other end of the vibration length of the string. When plucked, the string is free to vibrate between the bridge 26 and the nut 24. In the electric guitar, the vibrating string produces the sound by interaction with a magnetic pickup 30 on the body 12 of the guitar, as is known in the art. Thus, the string 20** of an electric guitar must be made of steel or other magnetic material. The sound of an acoustic instrument, such as an acoustic guitar, is produced through resonance in the hollow instrument body caused by the vibrating string.

The pitch produced by the string 20 depends on a number of factors. One factor is the vibration length of the string 20 between the bridge 26 and the nut 24. In general, the distance between the bridge and the nut is fixed for the instrument, and is the same for all strings.

Another factor to the pitch produced by the string is the mass per unit length of the string, which is generally related to the string diameter. Higher mass or larger diameter strings have lower resonant frequencies, and thus generate lower-pitch sounds. In a typical electric guitar having six strings, the three higher pitch strings are plain strings, consisting of a single strand of wire. The three lower pitch strings are typically wrapped strings, consisting of hexagonal wire wrapped with a wound covering of thin wire along the length of the wire. The core wire of a wrapped wire has a noncircular shape to provide edges for the wrap wire to cling to. Circular wires tend to allow the wrap wire to come loose.

A third factor in the pitch of the sound produced is the tension applied to the string. The tension on the string is typically adjusted by turning the tuning keys 22 on the head 16. Changing the pitch quickly while playing is not generally possible using the tuning keys 22. To add a new dimension to their sound, some guitarists now use a device that allows them to quickly vary the tension on the strings while playing, and thus vary the pitch and tone of the guitar's sound, without adjusting the tuning keys.

The device that allows this changing of the string tension is a pivoting bridge 26 on the body of the guitar, such as is shown in FIGS. 1 and 2. As can be seen in FIG. 2, the anchor end of each string 20 is attached to the string anchors 18*a*, 18*b* so as to be held securely. The string 20 is stretched across the bridge element 26*a*, 26*b* and the other end of each string is connected to the tuning key 22. The string is pulled tight across the bridge element 26*a*, 26*b*. The bridge elements are connected together and to a handle 32, so that movement of the handle 32 causes the bridge elements 26*a*, 26*b* to move away from the body of the guitar or toward the body of the guitar by pivoting on a pivot axis 34. As the bridge elements 26*a*, 26*b* move away from the body of the guitar, the tension of the strings is increased, as both ends of each string are firmly attached to an anchor 18*a*, 18*b* and to a tuning key 22. As the tension of the string increases, the pitch of the musical note produced by the vibrating string is increased. Conversely, when the bridge element moves closer to the body of the guitar, the tension on the string is reduced, and the pitch produced is lowered.

Using the pivoting bridge guitar players may apply more tension to the strings. Players have been experimenting with the pivoting bridge to obtain greater and greater variations in their sounds by taking the bridge movement to greater extremes. As greater tension has been applied to the strings, it has become apparent that conventional strings are not up to the demands placed upon them. This is especially true of the plain, single strand strings used to produce the higher pitch tones. These strings have been breaking with increased frequency, which is extremely frustrating to a musician in the middle of a song.

The reinforced musical instrument string of the invention is a plain string, as would be typically useful in producing the instrument's higher pitch tones. This string has a wire reinforcing wrap 34 near its anchor end 20*a* that substantially reduces the chance of breakage of the string.

The reinforced plain string of the invention includes a round core wire 36 between 0.008 inch and 0.017 inch in diameter. The wire 36 or string is approximately 41 inches long, and has a looped anchor end 38 and a plain, straight end (not shown) to be received by a tuning key 22. The looped base end 38 of the string has the core wire 36 bent near its end, and doubled back on itself to form a closed loop 40. The end portion or segment of the wire is twisted or braided about a section of the core wire remote from the end of the wire, and adjacent the loop 40, to form a twisted segment 42 of wire adjacent the loop. The extreme tip 44 of the end segment of the wire, however, is preferably left straight, as a small tail and formed parallel to and adjacent the core wire 36. This insures no protruding wires or edges. The intertwined or braided section of wire 42 and the tail section 44 are both extremely short compared to the overall length of the guitar string, on the order of one-half inch to three-quarters inch.

For strings used on electric guitars, the loop contains a ball 46, which may be a spool shaped cylinder approximately ⅛ inch in axial length. The ball has an outer diameter of approximately 5/32 inch, and an inner diameter of approximately 3/32 inch. The outer surface of the ball preferably has a annular groove 48 to receive the loop portion 40 of the core wire. The loop 40 is formed tightly around the cylinder 46, with the wire fitting into the annular groove 48 on the outer surface of the cylinder to hold the ball in place. The ball fits into the string anchor 18 on the body of the instrument, as shown in FIG. 2.

Strings for certain instruments, such as banjos and mandolins, have no ball in the looped end 40 of the wire. The looped end 40 is attached directly to a hook or other mounting on the instrument body.

The string core wire 36 has a reinforcing wrap 34 formed of a second, wrap wire 50 wound tightly around the twisted segment of the core wire. This wrap wire 50 is preferably 0.0050 to 0.0055 inch in diameter, smaller than the diameter of the core wire 36 it is wrapping.

The wrap 34 is begun in a manner similar to the method of producing a completely wrapped string, as is known in the art. A short segment of the wrap wire 50 is laid parallel to a portion of the twisted segment 42 of core wire closest to the loop 40. The wrap begins adjacent the loop, wrapping not only the twisted segment of the core wire, but also the end segment of the wrap wire that is with the twisted segment, to hold the end of the wrap wire 50 in place. The second wire 50 is spirally wound tightly around the twisted segment 42 of the core wire, insuring that the twisted segment 42 of core wire is held tightly by the wrap wire 50.

The wrap 34 stops once the wrap has covered the twisted segment 42 of the core wire, although the wrap can extend a short distance beyond the end of the tail 44 of the end segment of the core wire. The wrap cannot extend more than a small amount beyond the end of the tail portion 44, as the wrap 34 should not cover the portion of the string core wire 36 that extends over the bridge 26. If the wrapped portion of the string extends over the bridge of the instrument, the tonal quality of the sound produced by the string will be affected. It is important that the vibrating portion of the string between the bridge 26 and the nut 24 be a simple uniform plain wire. Thus, the wrapped portion 34 of the core wire 36 is but a small fraction of the overall length of the musical instrument string. The wrapped section will typically be approximately three-quarters of an inch to one inch in length to ensure no overlay with the instrument's bridge occurs. The wrapped portion of the string for most instruments should be no more than one inch in length. As the string is mounted on the instrument as shown in FIG. 2, the length of the wire or distance from the anchor end 20*a* to the point at which the wire passes over the bridge 26*a*, 26*b* is longer than the length of the wire wrapped by the wrap wire.

At the end of the wrapped section, the wrap wire 50 is clipped off immediately adjacent the core wire 36. The tip of the wrap wire 50 may need to be filed or buffed so no sharp edges protrude to injure the player or mar the instrument. Thus, the end of the wrap wire is smooth to the touch.

Although the dimensions given in this specification are for a wire string used on a typical electric guitar, it will be apparent to those skilled in the field that certain other instruments have different dimensions which may require a different dimension to the manufacture of the string of the invention. It remains important, however, that the wrapped portion of the string not extend beyond the bridge 26 of the instrument, so that the vibrating portion of the string, between the bridge 26 and the nut 24, does not have any wrap on it that may alter the vibrating characteristics of the string.

The reinforced plain string of the invention can be manufactured using conventional wire wrapping equipment. However, the operation of the equipment must be modified so as to halt the wrapping operation immediately after the twisted segment of the wire has been wrapped. The core wire used in the invention is round or circular in cross section, as the hexagonal wire used in a typical fully wrapped string would unduly rub the skin on the player's finger tips. Although the fully wrapped wires must continue to use hexagonal wire, in the invention round wire must be used. The twisted segment provides a base on which the wrap wire can anchor itself and not come loose.

I claim:

1. A musical instrument string adapted to be mounted on a musical instrument having a string anchor and a bridge comprising:

a core wire having a looped end and a twisted segment adjacent the loop end, said looped end adapted to be received by said string anchor when the string is mounted on the musical instrument; and a wrap wire of smaller diameter than said core wire wound tightly around the twisted segment of the core wire, the length of core wire wound by the warp wire being a small fraction of the overall length of the core wire and lying entirely between said string anchor and said bridge when the string is mounted on the musical instrument, whereby the musical string enables a reinforced mounting connection to be made with a string instrument without affecting the harmonic vibrations of the string due to the vibrational isolation of the reinforced connection provided by the bridge.

2. The musical instrument string defined in claim 1, additionally comprising a substantially spool shaped cylinder held within the loop at the looped end of the core wire.

3. The musical instrument string defined in claim 1, wherein the length of core wire wound by the wrap wire is no more than one inch.

4. The musical instrument string defined in claim 1, wherein the end of the wrap wire remote from the looped end of the core wire is trimmed close to the core wire so as to not provide any sharp edges to a person's touch.

5. A musical instrument string providing a reinforced attachment to a musical instrument of the type having a string anchor and a bridge at a first end and a tuning key and nut at a second end, the linear distance between said bridge and said nut defining a vibration length, the instrument string comprising:

a core wire, bent a short distance from one end thereof, wherein the end segment of the core wire is twisted together with a segment of the core wire remote from the end, so that the core wire has a looped end and a twisted segment adjacent the looped end; and a warp wire of smaller diameter than said core wire wound tightly around the twisted segment of the core wire, wherein the length of the core wire wound with the wrap wire is a small fraction of the overall length of the core wire and forms no part of said vibration length when the instrument string is placed on said musical instrument.

6. The musical instrument string defined in claim 5 wherein the twisted segment of the core wire terminates in a tip or tail segment, wherein the tail segment extends alongside the core wire, substantially parallel the core wire and forms part of said length of core wire wound with the wrap wire.

7. The musical instrument string defined in claim 5, wherein the core wire has a circular cross-section.

8. The musical instrument string defined in claim 5, additionally comprising a cylinder having an annular groove formed in its outer surface, wherein the cylinder is fitted within the loop of the looped end of the core wire.

9. A string for a musical instrument, the musical instrument comprising a body having a string anchor and a bridge and with a pre-selected vibration length, the string comprising:

a first wire having a base end adapted to be attached to the string anchor of the musical instrument so the string can be pulled taut across the bridge, wherein the distance along the first wire from the anchor to the bridge defines a first length of the first wire; and a wrap comprising a second wire of smaller diameter than said first wire spirally wound on a segment of the first wire near the base end to form a wrapped segment of the first wire, the wrapped segment having a second length, wherein the second length is shorter than the first length, so the wrapped segment of the first wire does not pass over the bridge when the string is attached to the string anchor and pulled taut across the bridge and thus does not form part of said vibration length.

10. The musical instrument string defined in claim 9, wherein the end of the second wire is trimmed close to the first wire so as to be smooth to a person's touch.

* * * * *